US008381629B2

(12) United States Patent
Szecsei

(10) Patent No.: US 8,381,629 B2
(45) Date of Patent: Feb. 26, 2013

(54) DOUBLE BARREL BOLT ACTION RIFLE

(76) Inventor: Joseph Szecsei, Windsor (CA)

( * ) Notice: Subject to any disclaimer, the term of this patent is extended or adjusted under 35 U.S.C. 154(b) by 118 days.

(21) Appl. No.: 13/096,412

(22) Filed: Apr. 28, 2011

(65) Prior Publication Data

US 2012/0005932 A1 Jan. 12, 2012

(51) Int. Cl.
*F41F 1/08* (2006.01)
*F41C 7/00* (2006.01)

(52) U.S. Cl. ..... 89/1.41; 42/16

(58) Field of Classification Search ..... 42/16–19; 89/1.41, 20.2, 33.1, 11
See application file for complete search history.

(56) References Cited

U.S. PATENT DOCUMENTS

| | | | | | |
|---|---|---|---|---|---|
| 1,395,460 | A | * | 11/1921 | Thompson | 89/126 |
| 2,338,682 | A | * | 1/1944 | Bohan | 89/21 |
| 3,203,129 | A | * | 8/1965 | Elkas | 42/76.01 |
| 3,253,362 | A | * | 5/1966 | Gitchell | 42/16 |
| 3,341,963 | A | * | 9/1967 | Seiderman | 42/16 |
| 3,426,465 | A | * | 2/1969 | Robinson Jr. | 42/16 |
| 3,631,620 | A | * | 1/1972 | Ohira | 42/16 |
| 3,653,140 | A | * | 4/1972 | Alday | 42/16 |
| 4,015,357 | A | * | 4/1977 | Andersson | 42/16 |
| 4,402,152 | A | * | 9/1983 | Casull | 42/16 |
| 4,698,931 | A | * | 10/1987 | Larsson | 42/16 |
| 4,920,677 | A | * | 5/1990 | Schuerman | 42/16 |
| 5,440,963 | A | * | 8/1995 | Szecsei | 89/1.41 |
| 5,941,004 | A | * | 8/1999 | Pedersoli | 42/51 |
| 6,415,701 | B1 | * | 7/2002 | Dobbins | 89/1.41 |
| 2001/0045044 | A1 | * | 11/2001 | Kroll | 42/16 |
| 2010/0257768 | A1 | * | 10/2010 | Barrett | 42/16 |
| 2012/0005932 | A1 | * | 1/2012 | Szecsei | 42/16 |
| 2012/0137557 | A1 | * | 6/2012 | Klotz | 42/16 |

FOREIGN PATENT DOCUMENTS

CA 2080712 A1 9/2002

OTHER PUBLICATIONS

Office Action dated Jul. 12, 2011 from Canadian Intellectual Property Office in Application No. 2,709,047 (2 pages).

* cited by examiner

*Primary Examiner* — Bret Hayes
*Assistant Examiner* — Joshua Freeman
(74) *Attorney, Agent, or Firm* — Taylor IP, P.C.

(57) ABSTRACT

A bolt body for a double barreled bolt action rifle comprises a pair of forwardly extending breach bolts; a central body portion, from which the breach bolts extend; and a rear portion of the bolt body, housing a pair of cocking pieces. The rear portion has intersecting vertical and horizontal slots formed therein, defining a cruciform track in which the cocking pieces can travel. Each cocking piece has a vertical portion accommodated in said vertical slot and a horizontal portion in said horizontal slot.

4 Claims, 2 Drawing Sheets

DOUBLE BARREL BOLT ACTION RIFLE

BACKGROUND OF THE INVENTION

1. Field of the Invention

The present invention relates to the field of firearms. In particular, the present invention provides certain improvements in bolt-action firearms. More particularly, the present invention provides certain improvements in double barrel bolt action repeating firearms. The present invention is particularly applicable to over/under double barrel bolt action repeating rifles.

2. Description of the Related Art

A double barrel bolt action firearm is described in Canadian Patent No. 2,080,712 dated Sep. 12, 2002. That patent shows a double barreled repeating firearm with a number of important technical innovations. Included among the innovations in CA 2,080,712 is a bolt assembly comprising a bolt body having a pair of forwardly extending parallel breach bolts extending therefrom. The bolt body also houses a firing pin assembly with a pair of firing pins concentric with the breach bolts and a cocking piece assembly with a pair of cocking pieces, one for each firing pin. Since the bolt body has a pair of breach bolts extending therefrom, one for each barrel of the firearm, the bolt body cannot be rotated in a manner similar to a bolt of a typical bolt action firearm. It is therefore provided with a collar that is fixed relative to the longitudinal axis of the bolt body, but rotatable relative to the bolt body. The collar has locking means, such as lugs or interrupted threads formed on its external surface that are co-operable with complementary locking means formed in the receiver of the firearm. The collar is provided with a handle, so that the collar can be rotated to an unlocked position, and the bolt assembly withdrawn to eject spent cartridges, and begin to cycle fresh cartridges into the firing chamber, and withdraw and cock the firing pins. It will be understood that the bolt assembly of the double barrel bolt action firearm described in CA 2,080,712 is substantially rectangular, because of the parallel pair of bolts, and it is fairly heavy. Therefore, when it is withdrawn, there exists a need to keep the bolt steady, and properly aligned with the receiver.

In CA 2,080,712, the Applicant (who is also the current Applicant), stated in the paragraph linking pages 7 and 8 that a bolt body constructed in one piece with a breach bolts is considered superior to a bolt assembly with separate breach bolts that attach to the bolt body. This was stated to be possible, but that it would increase manufacturing costs.

A further area of improvement of the present invention concerns the bolt body and cocking pieces. In CA 2,080,712, the bolt body includes a front piece to which the breach bolts are attached. Extending rearwardly from the front piece are a spaced pair of body members, between which are positioned the cocking pieces. The cocking pieces slide beside each other, and each is captive in a dovetail groove of one of the pair of body members. This type of sliding connection between the cocking pieces and the bolt body is expensive to produce, and requires that the parts be machined to very fine tolerances.

SUMMARY OF THE INVENTION

The present invention addresses the forgoing drawbacks of the firearm described in CA 2,080,712. In particular, the present invention provides an external bolt guide/rest at the rear of the receiver, preferably slotted to accommodate rearward travel of the bolt body as it is withdrawn and maintain the alignment of the bolt body with the receiver. By doing so, the breach bolts maintain alignment with the cartridge chambers and barrel bores.

The present invention also provides a bolt body, preferably manufactured as a single piece with the breach bolts, that accommodates a pair of cocking pieces that fit together side by side to form a cruciform structure that fits into, and slides within, horizontal and vertical slots in the bolt body, eliminating the need for machined dovetail joints in the cocking pieces and bolt body. Moreover, the cocking pieces are substantially longer than the travel of same so that as the cartridge in each barrel of the firearm is discharged, there is no chance of the cocking pieces jamming.

In a broad aspect, then, the present invention relates to a bolt body for a double barreled bolt action rifle comprising: a pair of forwardly extending breach bolts; a central body portion, from which said breach bolts extend; and a rear portion of the bolt body, housing a pair of cocking pieces; wherein said rear portion has intersecting vertical and horizontal slots formed therein, defining a cruciform track in which said cocking pieces can travel, each said cocking piece having a vertical portion accommodated in said vertical slot and a horizontal portion in said horizontal slot.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplifications set out herein illustrate one embodiment of the invention, and such exemplifications are not to be construed as limiting the scope of the invention in any manner.

DETAILED DESCRIPTION OF THE INVENTION

Figure 1:
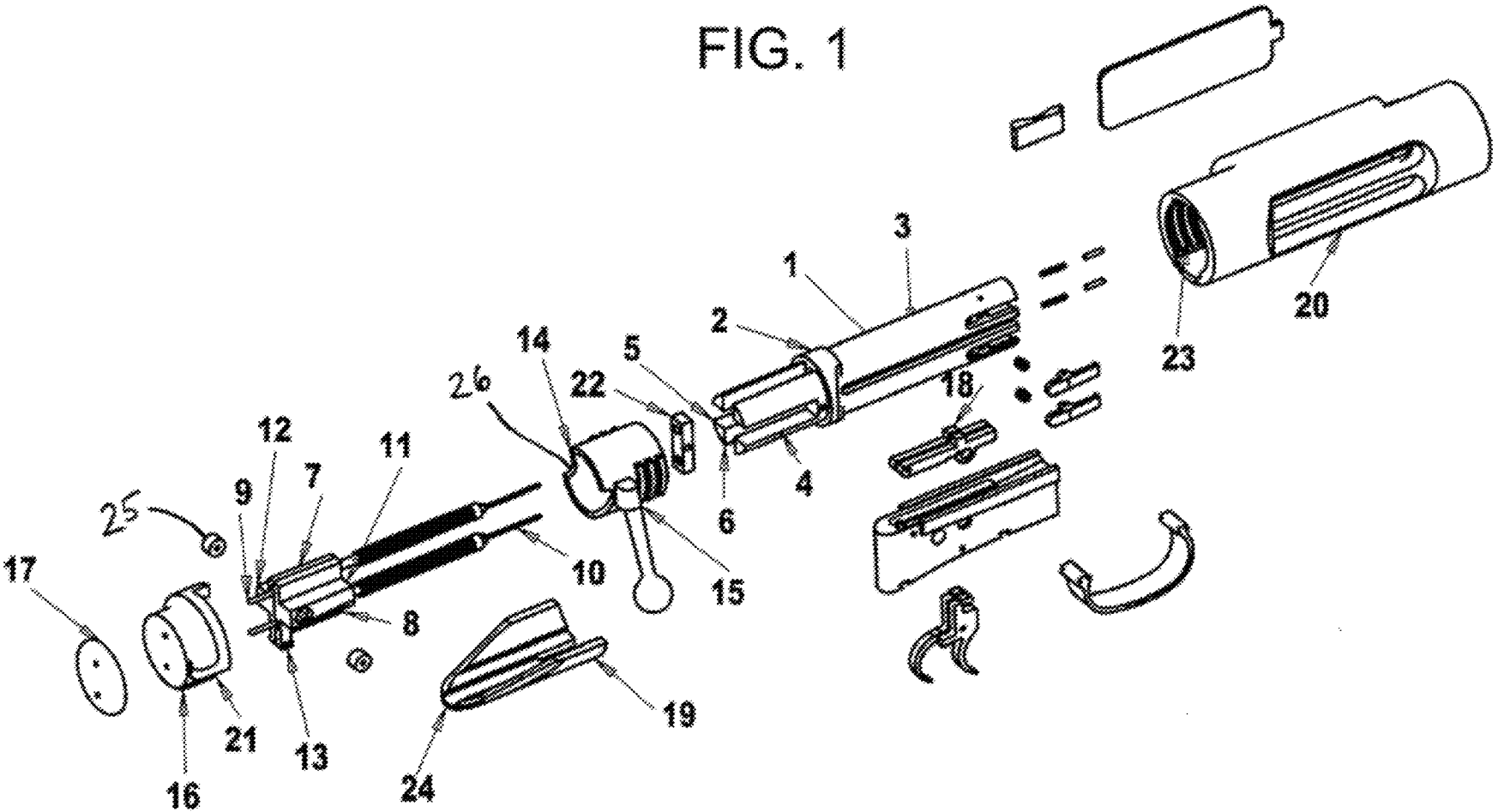
FIG. 1 is an exploded view of the bolt assembly and receiver of an over/under double barrel bolt action firearm embodying the improvements of the present invention.

Referring now to FIG. 1, the bolt assembly 1 of the present invention comprises a bolt body 2, preferably integrally machined with a pair of parallel, forwardly extending breach bolts 3. Extending rearwardly from the front of the bolt body is the rear portion 4 of the bolt body. The rear portion has intersecting horizontal 5 and vertical 6 slots, into which a cruciform shaped cocking piece assembly is slid.

The cocking piece assembly consists of right 8 and left 9 cocking pieces, each of which has a firing pin 10 extending therefrom. Each of the right and left cocking pieces has a horizontal arm 11 that can be slid in the horizontal slot 5 of the bolt body. Each of the right and left cocking pieces has an upper 12 and a lower 13 portion that extends above and below, respectively, the horizontal arms 11, so that when the two cocking pieces are side-by-side, the upper 12 and lower 13 portions of the respective cocking pieces respectively together define upper and lower arms of the cruciform cocking piece assembly. The upper and lower arms travel in the vertical slot of the bolt body.

The bolt assembly 1 also comprises a collar 14 with a handle 15, for withdrawing and locking the bolt assembly in the receiver. The collar fits over the rearward, slotted portion of the bolt body, and is held in place by an end piece 16 that is fastened to the bolt body. A cap 17 may be provided over the end piece, to help dirt and debris from fouling the firing pins.

The firing pins are accommodated in bores extending through the breach bolts. Each firing pin is fastened to, and extends forwardly of, a cocking piece. Between the cocking piece and the front portion of the bolt body, around each firing pin, is a firing pin spring.

At the rearward end of each cocking piece, extending laterally outwardly therefrom so that it extends out of the horizontal slot in the bolt body is a short cam follower 25 that will rest against a cam 26 formed on each side of the rear edge of the collar, so that when the collar is rotated, the firing pins are withdrawn to a cocked position by the pressure of the cams 26 against the cam followers 25. After the bolt body is fully withdrawn and then moved forward to a locked portion, the lower edges of the cocking pieces will each catch a sear 18 of a trigger, resulting in the cocking of the firearm (both barrels). The trigger assembly is conventional.

It will be observed that as each trigger is pulled, the cocking piece, and therefore the firing pin, for only one barrel is released. According to the improvement of the present invention then, the cocking pieces are quite long, to avoid any tilting or jamming as they slide past each other.

The present invention also provides an external bolt guide/rest 19, which may be integral with the receiver 20 or may be separate piece, for attachment to the stock, aligned to the receiver. This guide is elongated and concave, with a squared groove running its length, and it is aligned with the receiver so that when the bolt assembly is extracted to cock the firearm and cycle in new cartridges, a squared ridge 21 on the end piece, and the lower arms 13 of the cocking pieces will slide in the groove.

Moreover, a guide piece 22 may be provided in the bolt body 2, between the cocking piece assembly 7 and the front portion of the bolt body, in the vertical slot 6 of the bolt body. Guide piece 22 extends below bolt body 2, into a squared groove 23 in receiver 20. Groove 23 in receiver 20 is aligned with groove 24 in guide 19.

Figure 2:
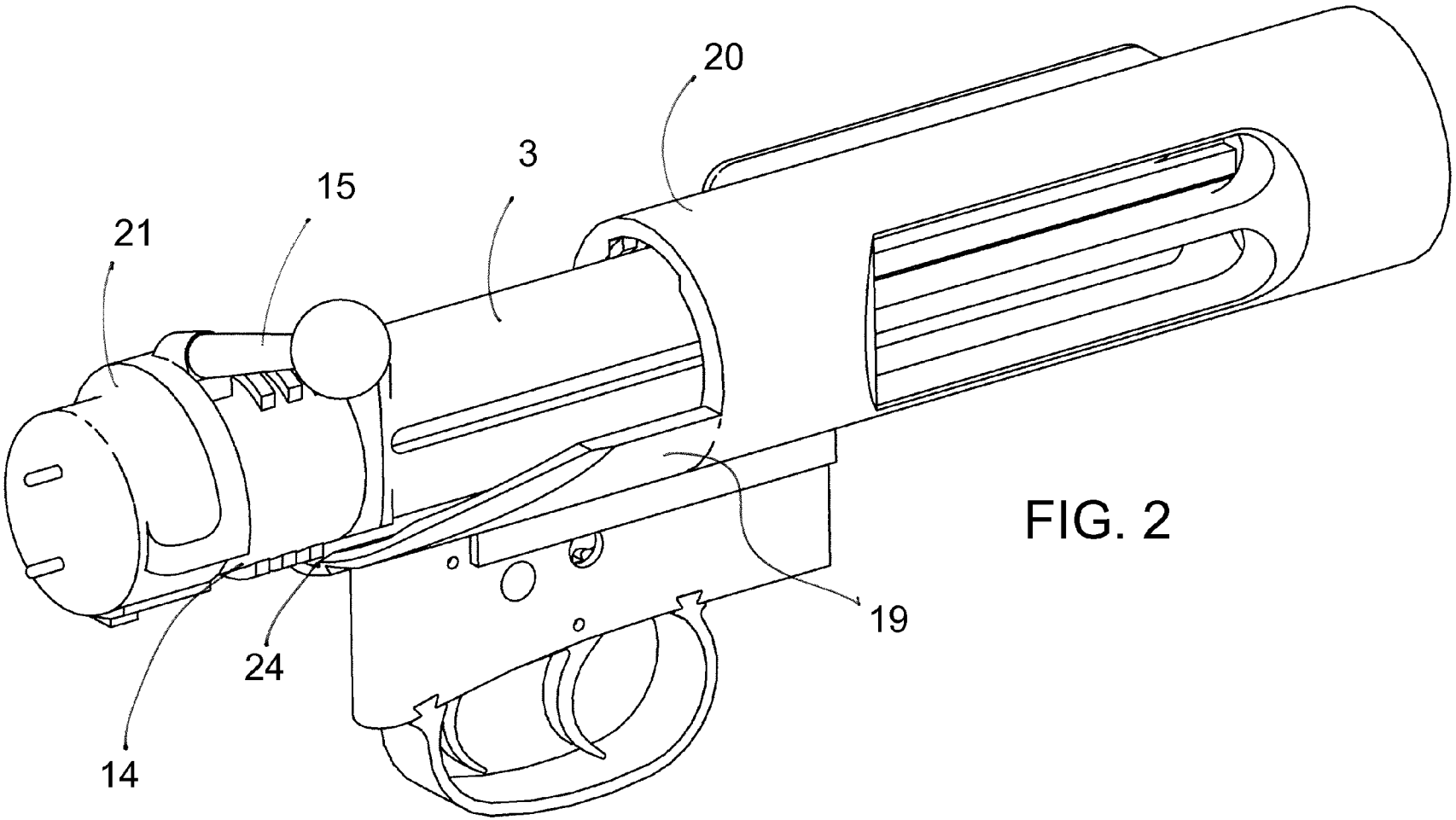
FIG. 2 is an assembled view of the bolt assembly and receiver shown in FIG. 1.

FIG. 2 is an assembled view of the bolt assembly 1 and receiver 20 shown in FIG. 1.

While this invention has been described with respect to at least one embodiment, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A double barreled bolt action rifle, comprising: a bolt body including a pair of forwardly extending breach bolts, a central body portion from which said breach bolts extend, and a rear portion having a vertical slot formed in said rear portion and a horizontal slot formed in said rear portion, said vertical and horizontal slots intersecting one another; and a pair of cocking pieces, said rear portion housing said pair of cocking pieces, said vertical and horizontal slots defining a cruciform track in which said cocking pieces can travel, each of said cocking pieces having a vertical portion accommodated in said vertical slot and a horizontal portion accommodated in said horizontal slot, and a guide piece between said cocking pieces and said central body portion, said guide piece extending below a lowermost extent of said cocking pieces.

2. The double barreled bolt action rifle as claimed in claim 1, wherein said vertical portions of said cocking pieces face each other and are accommodated side-by-side in said vertical slot of said rear portion of said bolt body.

3. The double barreled bolt action rifle as claimed in claim 1, further including a receiver and a bolt guide extending rearwardly from said receiver, said bolt guide having a channel in which said bolt body can travel.

4. The double barreled bolt action rifle as claimed in claim 1, wherein said breach bolts, said central body portion, and said rear portion thereof are integral with one another.

* * * * *